US009556642B1

(12) United States Patent
Gibson

(10) Patent No.: US 9,556,642 B1
(45) Date of Patent: Jan. 31, 2017

(54) FENCE POST PULLER

(71) Applicant: Sam Gibson, Chatsworth, GA (US)

(72) Inventor: Sam Gibson, Chatsworth, GA (US)

( * ) Notice: Subject to any disclaimer, the term of this patent is extended or adjusted under 35 U.S.C. 154(b) by 0 days.

(21) Appl. No.: 14/624,003

(22) Filed: Feb. 17, 2015

(51) Int. Cl.
*E21B 19/00* (2006.01)
*E04H 17/26* (2006.01)

(52) U.S. Cl.
CPC ..... *E04H 17/265* (2013.01)

(58) Field of Classification Search
CPC ..... E01F 9/011; B66F 3/36; E04H 17/265
USPC ..... 254/30
See application file for complete search history.

(56) References Cited

U.S. PATENT DOCUMENTS 3,048,368 A * 8/1962 Linabery, Sr. ..... E04H 17/265 254/130
3,848,850 A * 11/1974 Bemis ..... E02D 9/02 254/124
5,009,394 A * 4/1991 Marshall ..... E01F 9/011 254/30
5,224,687 A * 7/1993 Geckler ..... E04H 17/265 254/131
5,713,559 A * 2/1998 McClarin ..... B66F 15/00 254/124
D431,431 S 10/2000 Allen
6,398,188 B1 * 6/2002 Salman ..... E04H 17/265 254/30
6,527,250 B1 * 3/2003 Tyson ..... E04H 17/265 254/30
6,857,619 B1 2/2005 Jangula
7,185,880 B1 * 3/2007 McCray ..... E04H 17/265 254/30
7,290,754 B2 11/2007 Mensi
7,963,051 B2 * 6/2011 Ford ..... B66C 1/16 254/30
8,608,132 B1 12/2013 Allen
2010/0260590 A1 * 10/2010 Ford ..... B66C 1/16 414/815
2011/0062398 A1 3/2011 Ring-Gjerde
2012/0074362 A1 3/2012 Sanchez

* cited by examiner

*Primary Examiner* — Joseph J Hail
*Assistant Examiner* — Marc Carlson
(74) *Attorney, Agent, or Firm* — Kyle A. Fletcher, Esq.

(57) ABSTRACT

The fence post puller is a system that is adapted to extract a fence post from a ground. The fence post puller includes a lift plate that is used to extract said fence post, and a chain that is optionally used to force the fence post out of the ground via auxiliary means. The lift plate also includes a lift hole that is selectively attached to a hoist arm. The hoist arm is attached to a bottle jack, which is used to raise the lift plate and fence post. The bottle jack is affixed to a jack platform that disperses across a large surface area so as not to sink in an unstable ground or soil environment.

7 Claims, 5 Drawing Sheets

FENCE POST PULLER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fences and fence construction, more specifically, a fence post pulling device.

SUMMARY OF INVENTION

The fence post puller is a system that is adapted to extract a fence post from a ground. The fence post puller includes a lift plate that is used to extract said fence post, and a chain that is optionally used to force the fence post out of the ground via auxiliary means. The lift plate also includes a lift hole that is selectively attached to a hoist arm. The hoist arm is attached to a bottle jack, which is used to raise the lift plate and fence post. The bottle jack is affixed to a jack platform that disperses across a large surface area so as not to sink in an unstable ground or soil environment. The hoist arm includes a pair of bracket arms on a bottom distal end. The pair of bracket arms work in conjunction with a pair of "c" clips to attach onto the saddle portion of the bottle jack. The jack platform includes a pair of adjustable bolts and nuts that secure a base of the bottle jack to a top surface of the jack platform. The jack platform also includes a pair of platform armatures that extend outwardly.

These together with additional objects, features and advantages of the fence post puller will be readily apparent to those of ordinary skill in the art upon reading the following detailed description of the presently preferred, but nonetheless illustrative, embodiments when taken in conjunction with the accompanying drawings.

In this respect, before explaining the current embodiments of the fence post puller in detail, it is to be understood that the fence post puller is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fence post puller.

It is therefore important that the claims be regarded as including such equivalent construction insofar as they do not depart from the spirit and scope of the fence post puller. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
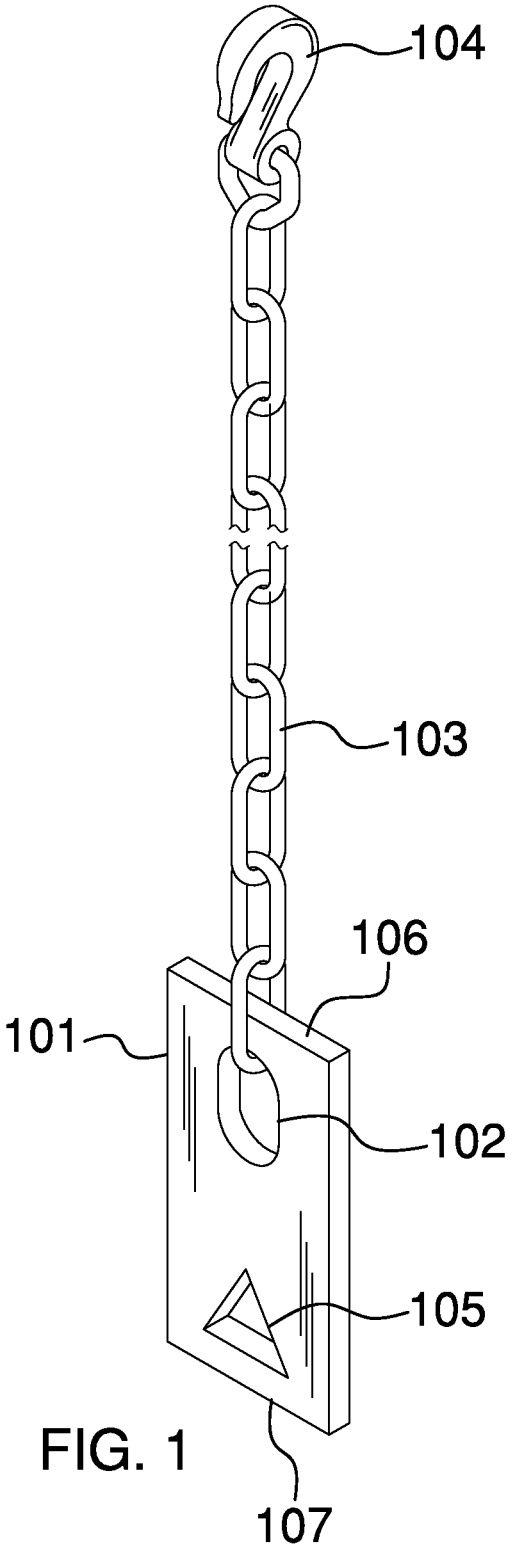
FIG. 1 is a perspective view of a lift plate of an embodiment of the disclosure.
Figure 2:
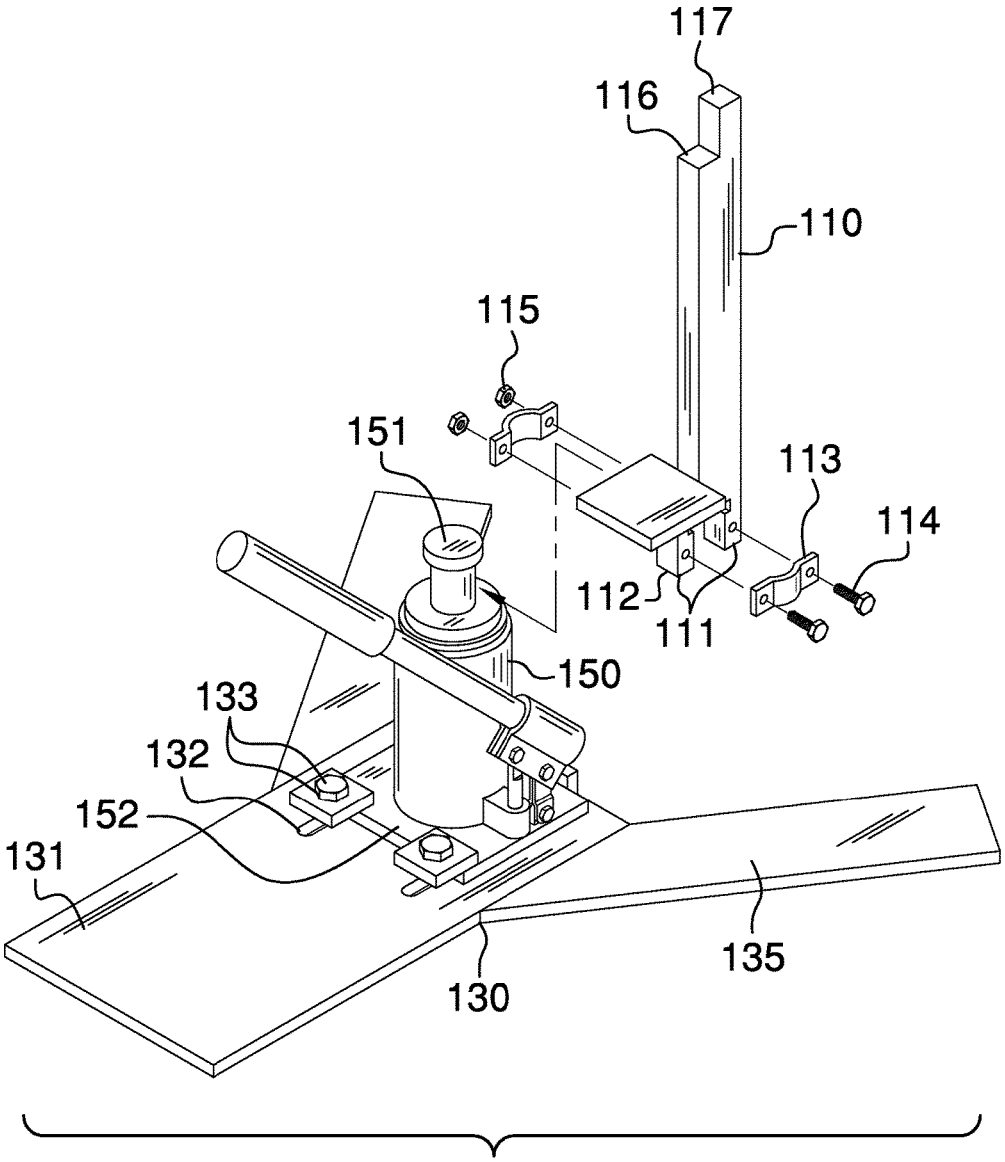
FIG. 2 is an exploded view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The fence post puller 100 (hereinafter invention) comprises a lift plate 101 that is rectangular in shape, and includes a lift hole 102 thereon. The lift plate 101 includes a chain 103 that is attached to the lift hole 102. The chain 103 includes a hook 104 thereon. The lift plate 101 also includes a fence post hole 105, which is opposite of the lift hole 102. The lift plate 101 shall be further defined with a first end 106 and a second end 107. The lift hole 102 is adjacent the first end 106; whereas the fence post hole 105 is adjacent the second end 107.

Figure 3:
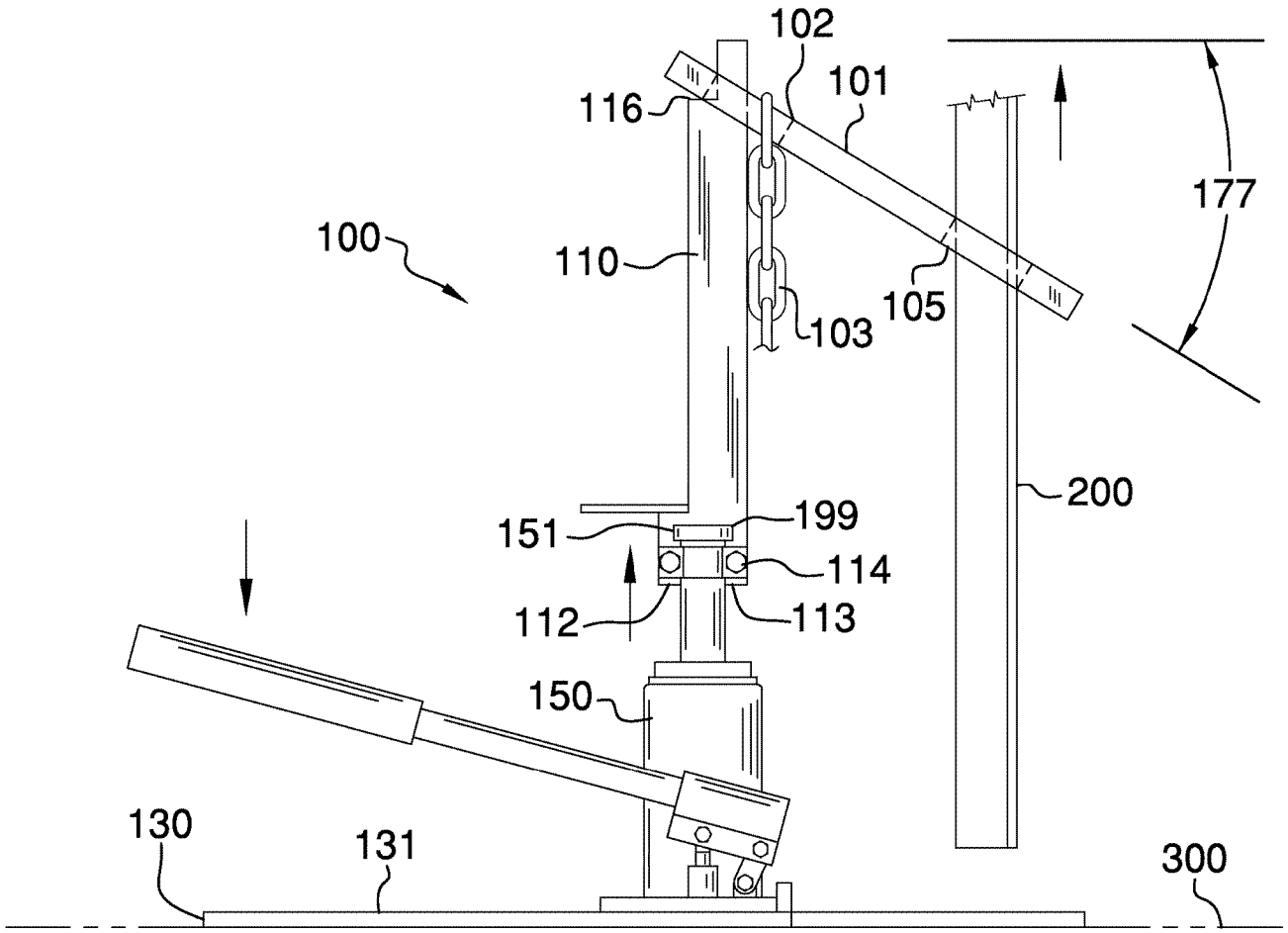
FIG. 3 is a side view of an embodiment of the disclosure in use.
Figure 4:
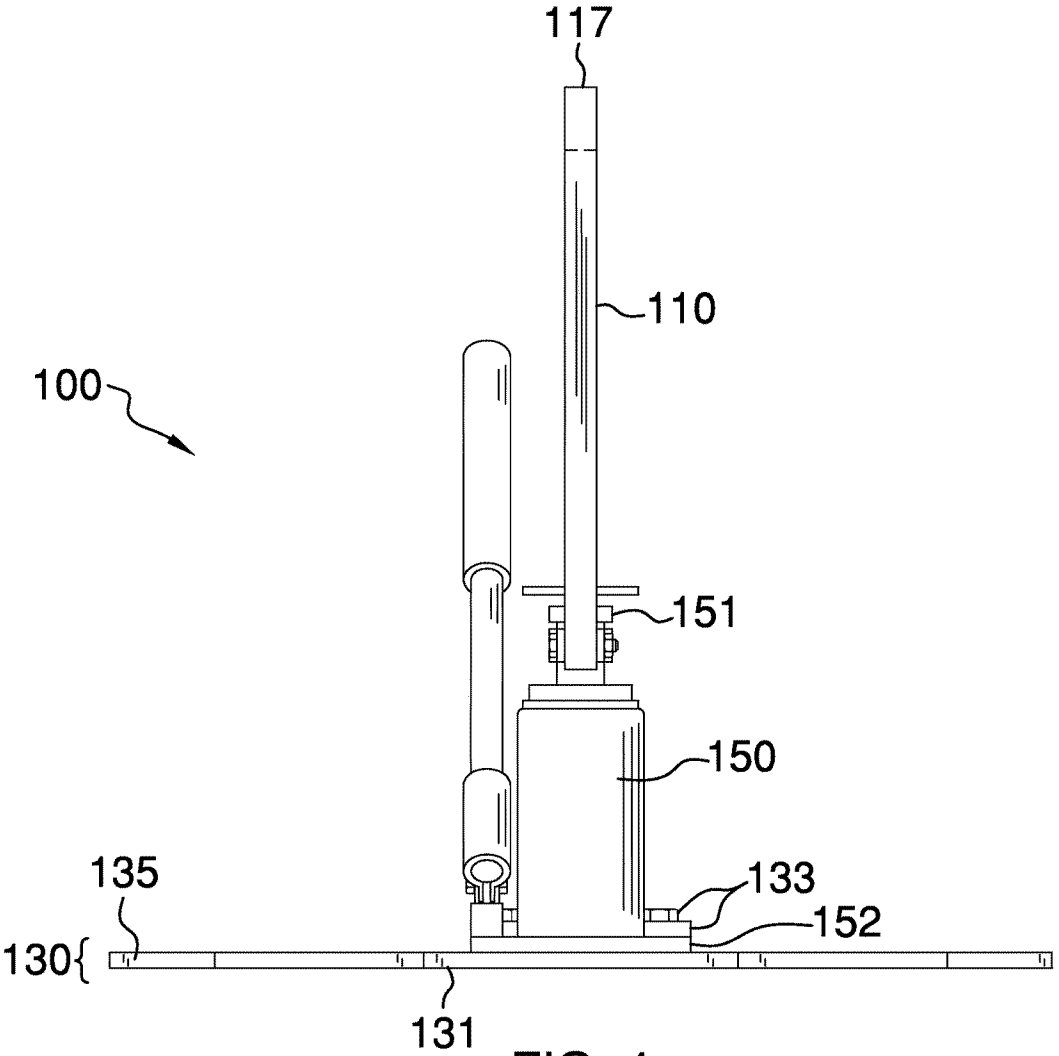
FIG. 4 is a front view of an embodiment of the disclosure.
Figure 5:
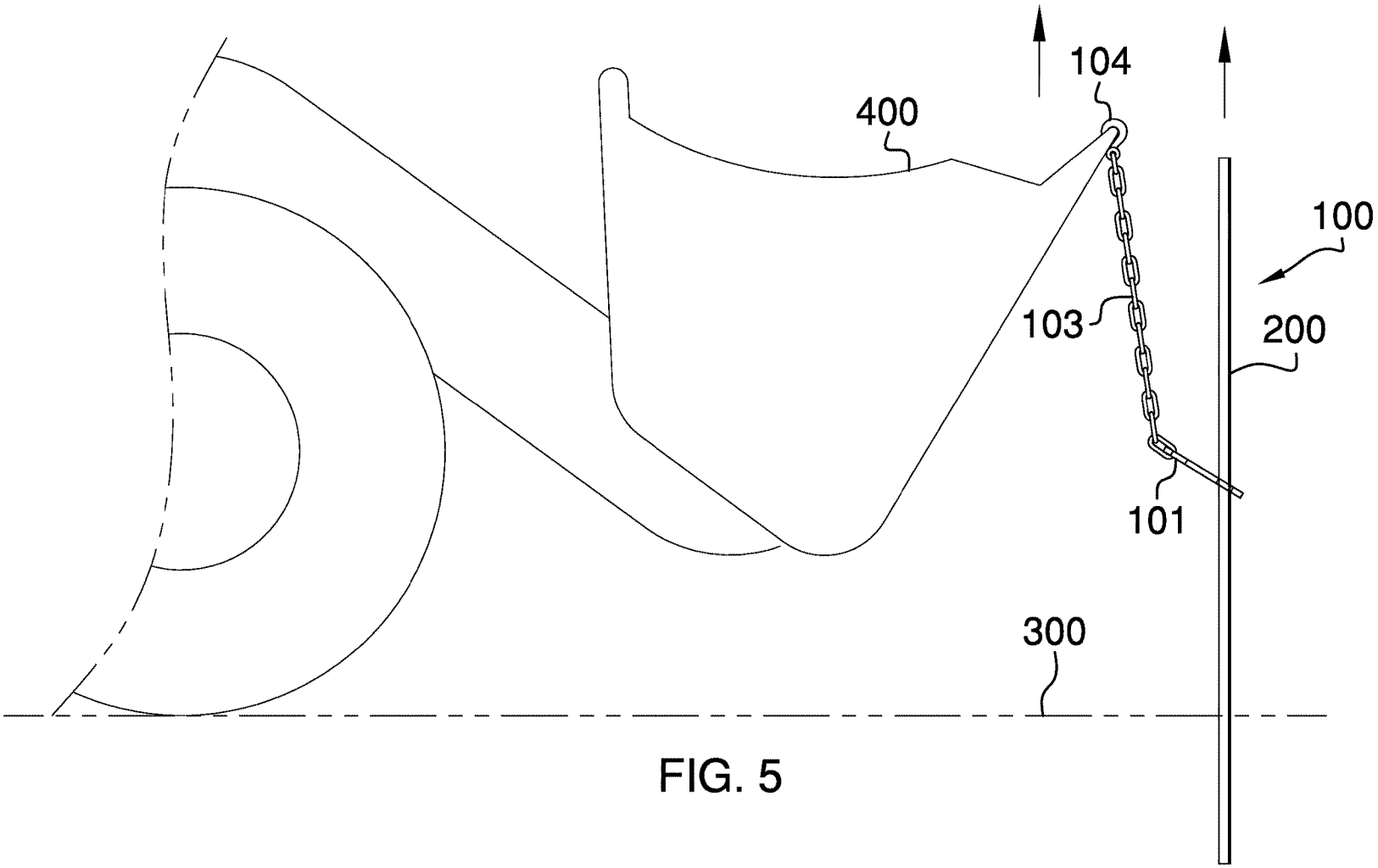
FIG. 5 is a side view of an embodiment of the disclosure in an alternative configuration for use.

The invention 100 is adapted to extract a fence post 200 from ground in one of two ways. Referring to FIG. 5, the chain 103 and the hook 104 are adapted to engage an auxiliary member 400, which is responsible for raising both the lift plate 101 and the fence post 200 vertically in order to extract the fence post 200 from a ground surface 300. The auxiliary means 400 may involve the use of a bucket on a piece of heavy equipment or any other means conceivable, which is able to provide vertical movement of the lift plate 101 via the chain 103 and the hook 104. Referring to FIG. 3, the invention 100 may be used in an alternative manner in order to extract the fence post 200 from the ground surface 300. Moreover, FIG. 3 depicts use of a bottle jack 150 to extract the fence post 200 from the ground surface 300.

The bottle jack 150 is secured to the lift plate 101 via a hoist arm 110. The hoist arm 110 attaches onto the bottle jack 150 via a pair of bracket arms 111 that extend downwardly from a bottom hoist end 112. The pair of bracket arms 111 work in concert with a pair of "c" clips 113 and a pair of nuts 114 and bolts 115 to secure the hoist arm 110 onto a saddle portion 151 of the bottle jack 150.

The hoist arm 110 is further defined with a hoist arm notch 116 provided at a top hoist end 117 of the hoist arm 110. The hoist arm notch 116 is used to be inserted through the lift hole 102 of the lift plate 101. It shall be noted that the hoist arm 110 is vertically oriented whereas the lift plate 101 is acutely oriented. The lift plate 101 is actually used at an angle 177 in order for the fence post hole 105 to engage the fence post 200 during extraction.

The bottle jack 150 is secured onto a jack platform 130. The jack platform 130 is adapted to rest onto the ground surface 300. Moreover, the jack platform 130 includes a first platform member 131 onto which the bottle jack 150 is secured. The first platform member 131 includes bolt holes 132 and bolt and nut members 133 that are able to slide back and forth with the first platform member 131 in order to engage and secure a bottle jack base 152 thereon. The jack platform 131 also includes a pair of platform armatures 135 that extend outwardly from the first platform member 131. The first platform member 131 and the pair of platform armatures 135 work in concert to spread over a large surface, the overall load generated via the bottle jack 150.

It shall be noted that the lift hole 102 of the lift plate 101 is generally elongated so as to enable the chain 103 and the hoist arm notch 116 to fit together. It shall also be noted that the pair of bracket arms 111 that extend downwardly from the bottom hoist end 112 actually a cutout 199 that mimics the contour of the saddle 151 of the bottle jack 150. The cutout 199 insures a more secure fitting of the saddle 151 of the bottle jack 150 with respect to the hoist arm 110.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fence post puller device for extracting a fence post from a ground surface, the device comprising:

a bottle jack with a bottle jack base and a saddle portion secured to a distal end of an extendable piston ram; the bottle jack base secured on top of a jack platform, the jack platform extending outwardly from bottle jack base in all directions to support the post puller device on the ground surface;

an elongated hoist arm extending upward and away from the ground surface comprising a bottom hoist end connected to the distal end of the extendable piston ram and a top hoist end, the top hoist end comprising a hoist arm notch, the bottom hoist end of the hoist arm comprising an integral pair of bracket arms spaced apart by a cutout that mimics the shape of the saddle portion and distal end of the extendable piston ram to permit the saddle portion and distal end of the extendable piston ram to mount therebetween;

a first strap clip connected to the pair of bracket arms on a first side of the hoist arm to secure the extendable piston ram in the cutout of the hoist arm;

a second strap clip connected to the pair of bracket arms on a second side of the hoist arm to secure the hoist arm to secure the extendable piston ram in the cutout of the hoist arm;

wherein the first strap clip and the second strap clip work in concert to provide a rigid mounting connection of the saddle portion and the extendable piston ram inside the cutout of the hoist arm;

a removable lift plate comprising a fence post hole and a lift hole; the fence post hole being shaped to engage a fence post at an angle and the lift hole being shaped to attach to the hoist arm notch on the hoist arm at the angle.

2. The fence post puller according to claim 1, wherein the first strap clip and second strap clip are connected to the pair of bracket arms with a pair of bolts.

3. The fence post puller according to claim 1, wherein the removable lift plate is rectangular.

4. The fence post puller according to claim 1, wherein a chain is affixed to the lift hole of the removable lift plate.

5. The fence post puller according to claim 4, wherein a hook is affixed to the chain opposite the removable lift plate.

6. The fence post puller according to claim 1, wherein the jack platform includes bolt holes and bolt and nut members that are able to slide back and forth with the jack platform in order to engage and secure the bottle jack base thereon.

7. The fence post puller according to claim 1, wherein the jack platform also includes a pair of platform armatures that extend outwardly from the first platform to increase the surface area of support of the post puller device on the ground surface.

* * * * *